US006763565B2

(12) United States Patent
Mukaigawa et al.

(10) Patent No.: US 6,763,565 B2
(45) Date of Patent: Jul. 20, 2004

(54) ROLL CHANGING APPARATUS AND ROLL CHANGING METHOD FOR ROLLING MILL

(75) Inventors: Satoshi Mukaigawa, Hiroshima (JP); Mikio Yamamoto, Hiroshima (JP); Osamu Yoshihara, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 136 days.

(21) Appl. No.: 09/994,798

(22) Filed: Nov. 28, 2001

(65) Prior Publication Data

US 2002/0078728 A1 Jun. 27, 2002

(30) Foreign Application Priority Data

Dec. 13, 2000 (JP) ..... 2000-378909
Dec. 20, 2000 (JP) ..... 2000-386431
Feb. 8, 2001 (JP) ..... 2001-234625

(51) Int. Cl.[7] ..... B23P 19/00

(52) U.S. Cl. ..... 29/426.1; 29/724; 29/428; 29/895

(58) Field of Search ..... 29/426.1, 402.01, 29/402.08, 426.3, 700, 710, 281.1, 895, 895.2, 895.213, 898.068, 428, 464, 465, 467, 38 B, 724

(56) References Cited

U.S. PATENT DOCUMENTS 4,630,781 A * 12/1986 Brown et al. ..... 241/159
4,649,631 A * 3/1987 Orth ..... 29/700
5,535,493 A * 7/1996 Hill et al. ..... 29/407.1

* cited by examiner

*Primary Examiner*—I. Cuda Rosenbaum
*Assistant Examiner*—Stephen Kenny
(74) *Attorney, Agent, or Firm*—Birch, Stewart, Kolasch & Birch, LLP

(57) ABSTRACT

A roll changing apparatus for a four-high rolling mill comprises rails, provided in a rolling mill stand and on a work side of the rolling mill, for incoming and outgoing of a work roll assembly and a backup roll assembly, and a pusher, provided on a drive side or the work side of the rolling mill, for roll admission and withdrawal for both of work rolls and backup rolls. The roll changing apparatus can be modified into a side shift type roll changing apparatus with ease, at a low cost, and in a short time.

12 Claims, 18 Drawing Sheets

(a) PRIOR ART (b) PRIOR ART (c) PRIOR ART

ROLL CHANGING APPARATUS AND ROLL CHANGING METHOD FOR ROLLING MILL

The entire disclosure of Japanese Patent Application No. 2001-234625 filed on Aug. 2, 2001 including specification, claims, drawings and summary is incorporated herein by reference in its entirety.

BACKGROUND OF THE INVENTION

1. Field of the Invention

This invention relates to a roll changing apparatus and a roll changing method for a rolling mill in rolling equipment.

2. Description of the Related Art

There have been roll changing apparatuses for four-high rolling mills as shown, for example, in FIGS. 14 to 18.

FIG. 14 shows a roll changing apparatus called a C-hook system. When upper and lower work rolls 100 are to be changed, for example, a lower end receiving portion 103 of a C-hook 102 exclusive to work rolls, which has been suspended from a hook 101 of a crane, is engaged with the shaft ends of the upper and lower work rolls 100 within a rolling mill stand 104. Then, the upper and lower work rolls (assembly) 100 are slightly lifted by handling of the crane to disconnect them from a lower backup roll (assembly) 105. (At this time, an upper backup roll (assembly) 105 has been slightly raised.) Then, the upper and lower work rolls 100 are pulled out into a pit P present before the rolling mill. Then, the upper and lower work rolls 100 are transported by the crane to a predetermined site of replacement, where they are changed to new upper and lower work rolls (assembly) 100. Changing of the upper and lower backup rolls 105 is also performed in a similar manner using a C-hook exclusive to backup rolls.

FIG. 15 shows a roll changing apparatus called a cluster system. When upper and lower work rolls 100 are to be changed, for example, a pit P before a rolling mill is opened, and the upper and lower work rolls (assembly) 100 are stacked on and supported by a lower backup roll (assembly) 105 supported on a sled 106 in a rolling mill stand 104. (At this time, an upper backup roll (assembly) 105 has been slightly raised.) Then, the sled 106 is moved on a base 108 by a hydraulic cylinder 107 to push out the upper and lower work rolls (assembly) 100 into the pit P before the rolling mill. Then, the upper and lower work rolls (assembly) 100 are changed to new upper and lower work rolls (assembly) 100 by a crane operation. After changing, the new upper and lower work rolls (assembly) 100 are set into the rolling mill stand 104 by the same procedure performed in reverse. Changing of the upper and lower backup rolls 105 is performed, in the case of the lower backup roll (assembly) 105, by exactly the same procedure as that for the upper and lower work rolls (assembly) 100, or in the case of the upper backup roll (assembly) 105, by a similar procedure using a stool (not shown; a so-called dummy for the upper and lower work rolls (assembly) 100) and placing the upper backup roll (assembly) 105 on the stool.

FIGS. 16 and 17 show a roll changing apparatus called a side shift system. In detail, a four-high rolling mill 50 on a rolling line has a rolling mill stand 51, upper and lower work rolls 52 as a pair, and upper and lower backup rolls 53 as a pair. In the drawings, Ds denotes a drive side of the rolling line, while Ws denotes a work side of the rolling line.

The above roll changing apparatus has a work roll pushing-out/pulling-in pusher 54 disposed on the drive side Ds of the rolling line, and a backup roll pulling-out/pushing-in hydraulic cylinder 55 disposed on the work side Ws of the rolling line. In FIG. 16, 54*a* denotes a connecting fitting at the tip of the pusher 54, 54*b* denotes a connecting fitting at the end of a roll chock 52*a* of the work roll 52 opposed to the pusher tip, 55*a* denotes a connecting fitting at the tip of the hydraulic cylinder 55, and 55*b* denotes a connecting fitting at the end of a roll chock 53*a* of the lower backup roll 53 opposed to the tip of the hydraulic cylinder 55.

Changing of the work rolls 52 is performed by a method which comprises relieving the upper backup roll 53 and the upper work roll 52 to ascending positions, raising the lower work roll 52 to a roll change height, pushing out the lower work roll 52 over a small distance by the pusher 54, lowering the upper work roll 52 onto the lower work roll 52 to stack them in a roll change posture, pushing out the upper and lower work roll assembly onto a shift table 56 by forward or extended driving of the pusher 54, replacing this old work roll assembly with a new work roll assembly by a shift or a shifting movement of the shift table 56 caused by a shifting cylinder 64, and pulling the new work roll assembly into the rolling stand 51. At this time, the work roll assembly is adapted to act such that wheels 57 mounted on the roll chocks 52*a* of the lower work roll 52 move on up-and-down rails 58*a* in the rolling mill stand 51 and on rails 58*b* on the shift table 56.

Changing of the backup rolls 53 is performed after pushing the work roll assembly out of the rolling mill stand 51 onto the shift table 56, and temporarily removing the work roll assembly, the shift table 56, a detachable girder 62*a*, and a detachable rail 63*a* located before the rolling mill. That is, changing of the backup rolls 53 is performed in the following manner: The connecting fitting 55*a* of the hydraulic cylinder 55 is coupled to the connecting fitting 55*b* on the side of the lower backup roll 53, and the lower backup roll 53 is pulled out to the work side Ws of the rolling line. At the pullout position, an upper backup roll-loading (roll changing) stool 59 is mounted on the lower backup roll 53, and they are pushed into the rolling mill stand 51. The upper backup roll 53 is lowered, and loaded on the stool 59, whereafter the upper and lower backup rolls 53 are pulled out to the work side Ws by the hydraulic cylinder 55. At the pullout position, the upper backup roll 53 is replaced with a new upper backup roll 53. The new upper backup roll 53 is pushed into the rolling mill stand 51, and set at a predetermined height position. The lower backup roll 53 loaded only with the stool 59 is pulled out to the work side Ws, where the stool 59 is detached, and the lower backup roll 53 is replaced with a new lower backup roll 53. The new lower backup roll 53 is pushed into the rolling mill stand 51, and set in place.

At this time, the weight of the assembly including the stool 59 and the upper and lower backup rolls 53, generally, moves slidingly on a slide base 61*a* in the stand 51 and on a slide base 61*b* on the work side Ws via slide members 60 provided at the roll chocks 53*a* of the lower backup roll 53.

When roll changing is performed by the above-described C-hook system or cluster system, a changing operation by handling of the crane accounts for most of this task, and requires labor and time. In recent years, therefore, a demand has risen for modifying equipment in order to switch to the side shift system that minimizes a changing operation by handling of the crane and requires minimal downtime for the rolling line.

With the aforementioned conventional side shift type roll changing apparatus, however, large drive devices (pusher 54 and hydraulic cylinder 55) for bringing the work rolls and the backup rolls into and out of the rolling mill stand are provided separately. Thus, the fixtures cost is high, and installation (accommodation) spaces for them have to be secured.

Furthermore, the shifting girders and rails in an upper part of the backup roll pulling-out pit need to have a separable, detachable rail structure for each rolling mill. Thus, the structure is complicated and upsized, and the cost and construction time involved in modification are increased. Incidentally, the detachable girder 62*a* (and rail 63*a*) has opposite end portions carried by the ends of fixed girders 62 (and rails 63), as shown in FIGS. 18(*a*) to 18(*c*), to take charge of the work roll weight of about 20 to 30 tons per girder (rail). To maintain the strength of the carried portion and prevent warpage of the rail, the cross section of the girder 62*a* (and the rail 63*a*) needs to be I-shaped, and needs to have predetermined dimensions in the height direction (i.e., $h_1$ and $h_2$). The dimension H on the fixed side depends on $h_1$, so that as $h_1$ increases, H also increases. In the absence of the detachable girder 62*a* (and rail 63*a*), on the other hand, the magnitude of H can be decreased. In other words, if it is necessary to mount the fixed girder 62 (and rail 63) into the channel-shaped pit, the depth of the pit can be made small.

SUMMARY OF THE INVENTION

The present invention has been proposed in consideration of the above problems with the earlier technologies. It is the object of the invention to provide a roll changing apparatus for a rolling mill which can be modified into a side shift type roll changing apparatus with ease, at a low cost, and in a short time.

A first aspect of the present invention, for attaining the above object, is a roll changing apparatus for a rolling mill, comprising:

rails, provided in a stand of the rolling mill and on a work side of the rolling mill, for incoming and outgoing of a work roll assembly and a backup roll assembly; and a pusher, provided on a drive side or the work side of the rolling mill, for roll admission and withdrawal for both of work rolls and backup rolls.

According to this aspect, changing of the work rolls and changing of the backup rolls can be performed by the single pusher, and the conventional hydraulic cylinder for the backup rolls, for example, can be omitted. Thus, the fixtures cost can be reduced markedly, and the range of formation of deep foundations can be decreased to cut down on the construction cost for foundations. Particularly in the case of modifying the existing equipment, the conventional backup roll pulling-out pit portion can be effectively used, unchanged, for modification. This results in marked shortening of the construction period and a marked decrease in the cost of modifying the foundations.

In the roll changing apparatus for a rolling mill, a roll changing stool to be assembled to the backup roll assembly may be provided with wheels and a connecting fitting for connection with the pusher so that the roll changing stool can be moved on the rails for incoming and outgoing of the work roll assembly by driving of the pusher.

According to the above feature, the pushing-out/pulling-in procedure by the pusher during backup roll changing is decreased by one reciprocation. Thus, a saving in labor is achieved.

In the roll changing apparatus for a rolling mill, lower backup roll chocks of the rolling mill may be provided with wheels so that the backup roll assembly can be moved by the wheels on the rails for incoming and outgoing of the backup roll assembly.

According to the above feature, movement of the backup roll assembly can be made smoothly compared with the use of the slide members.

In the roll changing apparatus for a rolling mill, the rails for incoming and outgoing of the backup roll assembly in the rolling mill stand can be raised and lowered by hoisting and lowering means, a lower backup roll chock may be equipped with a connecting fitting which can be connected to a drive end of the pusher at a raised position of the lower backup roll chock, and fixed rails for incoming and outgoing of the backup roll assembly on the work side may be provided at a height consistent with a raised height of the rails for incoming and outgoing of the backup roll assembly in the rolling mill stand.

According to the above feature, the same actions and effects as in the first aspect of the invention can be obtained, and the conventional roll changing stool can be used.

In the roll changing apparatus for a rolling mill, the lower backup roll chock may be movable on the rails and fixed rails for incoming and outgoing of the backup roll assembly via wheels.

According to the above feature, movement of the backup roll assembly can be made smoothly compared with the use of the slide members.

A second aspect of the invention is a roll changing method for a rolling mill, comprising:

actuating a work roll assembly and a backup roll assembly by a single pusher, provided on a drive side or a work side of the rolling mill, for roll admission and withdrawal in performing a roll changing operation from the work side of the rolling mill, whereby the work roll assembly and the backup roll assembly are admitted into or withdrawn from a rolling mill stand.

According to this aspect, changing of the work rolls and changing of the backup rolls can be performed by the single pusher, and the conventional hydraulic cylinder for the backup rolls, for example, can be omitted. Thus, the fixtures cost can be reduced markedly, and the range of formation of deep foundations can be decreased to cut down on the construction cost for foundations. Particularly in the case of modifying the existing equipment, the conventional backup roll pulling-out pit portion can be effectively used, unchanged, for modification. This results in marked shortening of the construction period and a marked decrease in the cost of modifying the foundations.

A third aspect of the invention is a roll changing apparatus for a rolling mill, the roll changing apparatus being a side shift roll changing apparatus installed on a work side of the rolling mill and comprising:

a shift table capable of aligning with a roll axis line position of the rolling mill; and shifting rails provided on a floor and a bottom of a backup roll pulling-out pit dividedly in a shifting direction in order to support the shift table at a required height, and wherein the shift table is shifted nearly horizontally in the pit by drive means while extending over a floor rail portion and a pit bottom rail portion.

According to the above aspect, the shift rail structure can be simplified and downsized, so that the expenses and construction period for modification can be reduced, and labor for maintenance and administration can be decreased. In changing the backup rolls, moreover, the conventional operation for mounting and dismounting the rails exclusive to the side shift trolley is unnecessary, markedly shortening the time for the changing operation.

The roll changing apparatus for a rolling mill may further include legs extending downwardly from an end portion of the shift table, which faces the pit, nearly perpendicularly into the pit, and lower end portions of the legs may be shiftable on the pit bottom rail portion while maintaining the shift table nearly horizontally.

According to this feature, the first shift table can smoothly shift on the shifting rails provided with a step.

In the roll changing apparatus for a rolling mill, discontinuous backup roll pulling-out rails, which do not cross the pit bottom rail portion, may be provided at the bottom of the pit so as to be capable of pulling out backup rolls to a higher position than the pit bottom rail portion.

According to this feature, the backup rolls can be smoothly pulled out without interference from the pit bottom rail portion.

In the roll changing apparatus for a rolling mill, a pair of wheels may be provided on a lower portion of a roll chock of the backup roll with a spacing greater than a lengthwise dimension of a discontinuous portion of the backup roll pulling-out rails.

According to this feature, the backup rolls can be smoothly rolled on the discontinuous rails, and pulled out of or pushed into the rolling mill stand.

In the roll changing apparatus for a rolling mill, a slide member of a length larger than a lengthwise dimension of a discontinuous portion of the backup roll pulling-out rails may be provided on a lower portion of a roll chock of the backup roll.

According to this feature, the backup rolls can be smoothly shifted on the discontinuous rails, and pulled out of or pushed into the rolling mill stand.

The roll changing apparatus for a rolling mill may further include a second shift table connected to the shift table, and the second shift table may shift such that one end thereof is detachably connected to and supported by an end portion of the first shift table facing the pit, and the other end thereof is supported on the floor rail portion on a side opposite to the first shift table, with the pit being located between the first shift table and the floor rail portion, and the second shift table may be supported on the floor rail portion at opposite end portions thereof in a state in which the first shift table has stopped at the roll axis line position of the rolling mill.

According to the this feature, the same actions and effects as in the third aspect of the invention are obtained, and the two shift tables are alternately aligned with and stopped at the position of the roll axis line of the rolling mill, achieving rapidity of the changing operation.

A fourth aspect of the invention is a roll changing method for a rolling mill, used in operating a roll changing apparatus of a side shift type installed on a work side of the rolling mill and having a shift table to be aligned with a roll axis line position of the rolling mill, comprising:

shifting the shift table by moving the shift table on shifting rails provided on a floor and a bottom of a backup roll pulling-out pit dividedly in a shifting direction.

According to the above aspect, the shift rail structure can be simplified and downsized, so that the expenses and construction period for modification can be reduced, and labor for maintenance and administration can be decreased. In changing the backup rolls, moreover, the conventional operation for mounting and dismounting the rails exclusive to the side shift trolley is unnecessary, markedly shortening the time for the changing operation.

A fifth aspect of the invention is a roll changing apparatus of a side shift type for a rolling mill, installed on a work side of the rolling mill and comprising:

rails, provided in a stand of the rolling mill and on a work side of the rolling mill, for incoming and outgoing of a work roll assembly and a backup roll assembly;

a pusher, provided on a drive side or the work side of the rolling mill, for roll admission and withdrawal for both of work rolls and backup rolls;

a shift table capable of aligning with a roll axis line position of the rolling mill; and shifting rails provided on a floor and a bottom of a backup roll pulling-out pit dividedly in a shifting direction in order to support the shift table at a required height, and wherein the shift table is shifted nearly horizontally in the pit by drive means while extending over a floor rail portion and a pit bottom rail portion.

According to this feature, the conventional hydraulic cylinder for the backup rolls can be omitted. Thus, the fixtures cost can be reduced markedly, and it becomes unnecessary to construct foundations, such as the pit, which are formed for accommodating the hydraulic cylinder. In addition, the side shifting rail structure of the backup roll pulling-out pit has been changed from a detachably constructed system to a fixedly laid system. Thus, the structure can be simplified and downsized. Particularly when the channel-shaped pit is formed, its depth can be decreased. Consequently, the expenses and construction period for modification can be markedly reduced.

A sixth aspect of the invention is a roll changing method for a rolling mill, used in operating a roll changing apparatus of a side shift type installed on a work side of the rolling mill and having a shift table to be aligned with a roll axis line position of the rolling mill, comprising:

actuating a work roll assembly and a backup roll assembly by a single pusher, provided on a drive side or the work side of the rolling mill, for roll admission and withdrawal, whereby the work roll assembly and the backup roll assembly are admitted into or withdrawn from a rolling mill stand, and shifting the shift table by moving the shift table on shifting rails provided on a floor and a bottom of a backup roll pulling-out pit dividedly in a shifting direction.

According to this feature, the same actions and effects as in the fifth aspect of the invention can be obtained.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A roll changing apparatus and a roll changing method for a rolling mill according to the present invention will now be described in detail by preferred embodiments with reference to the accompanying drawings, which in no way limit the invention.

First Embodiment

Figure 1:
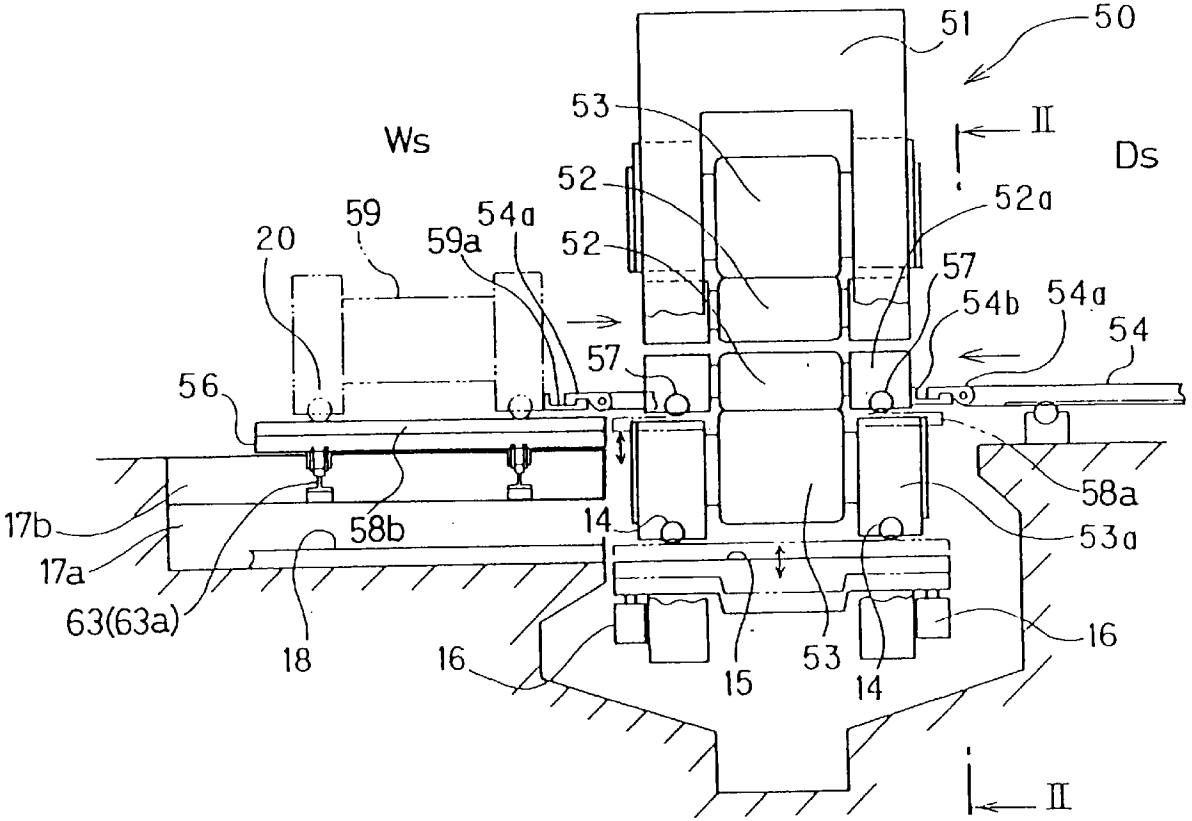
FIG. 1 is a front view of a four-high rolling mill according to a first embodiment of the present invention.
Figure 2:
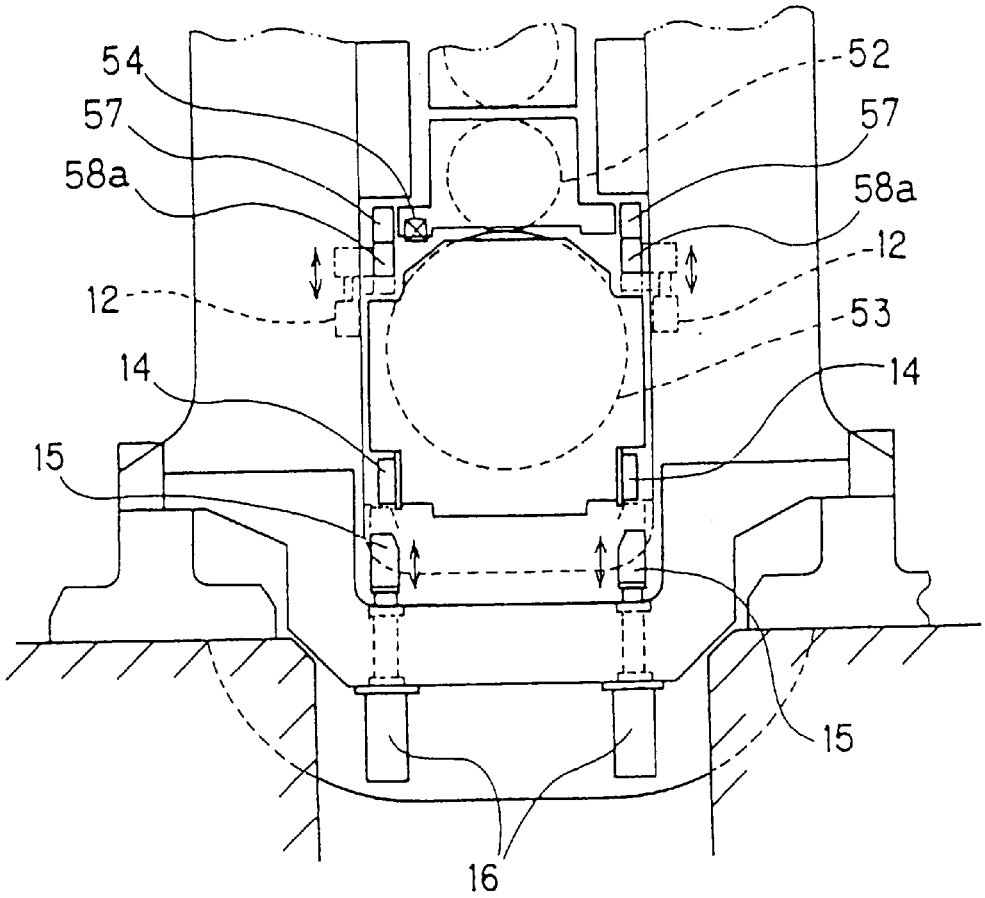
FIG. 2 is a view taken on line II—II in FIG. 1.
Figure 3:
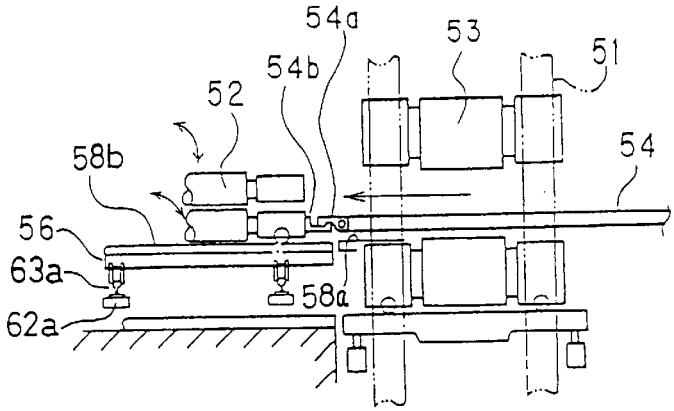
FIGS. 3(A) to 3(C) are explanation drawings of a roll changing procedure for the four-high rolling mill.
Figure 3:
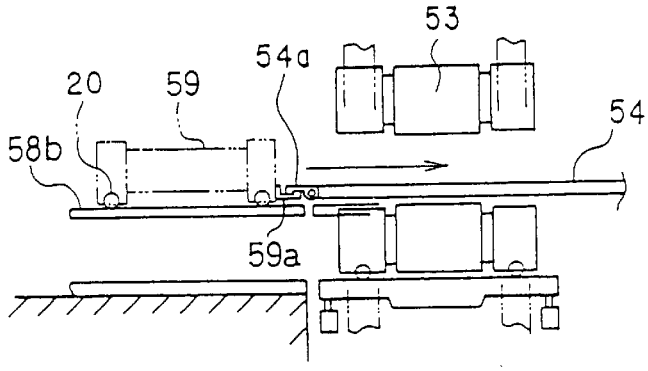
Figure 3:
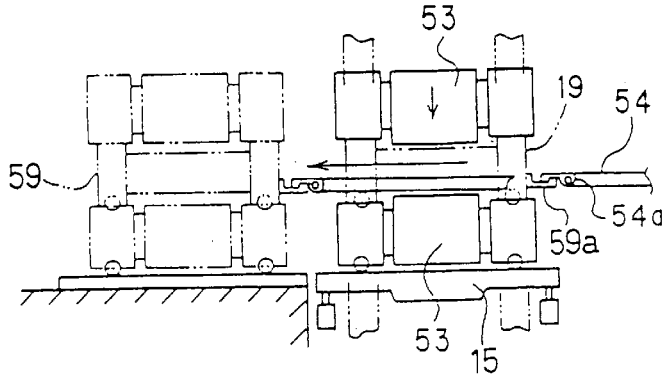
Figure 16:
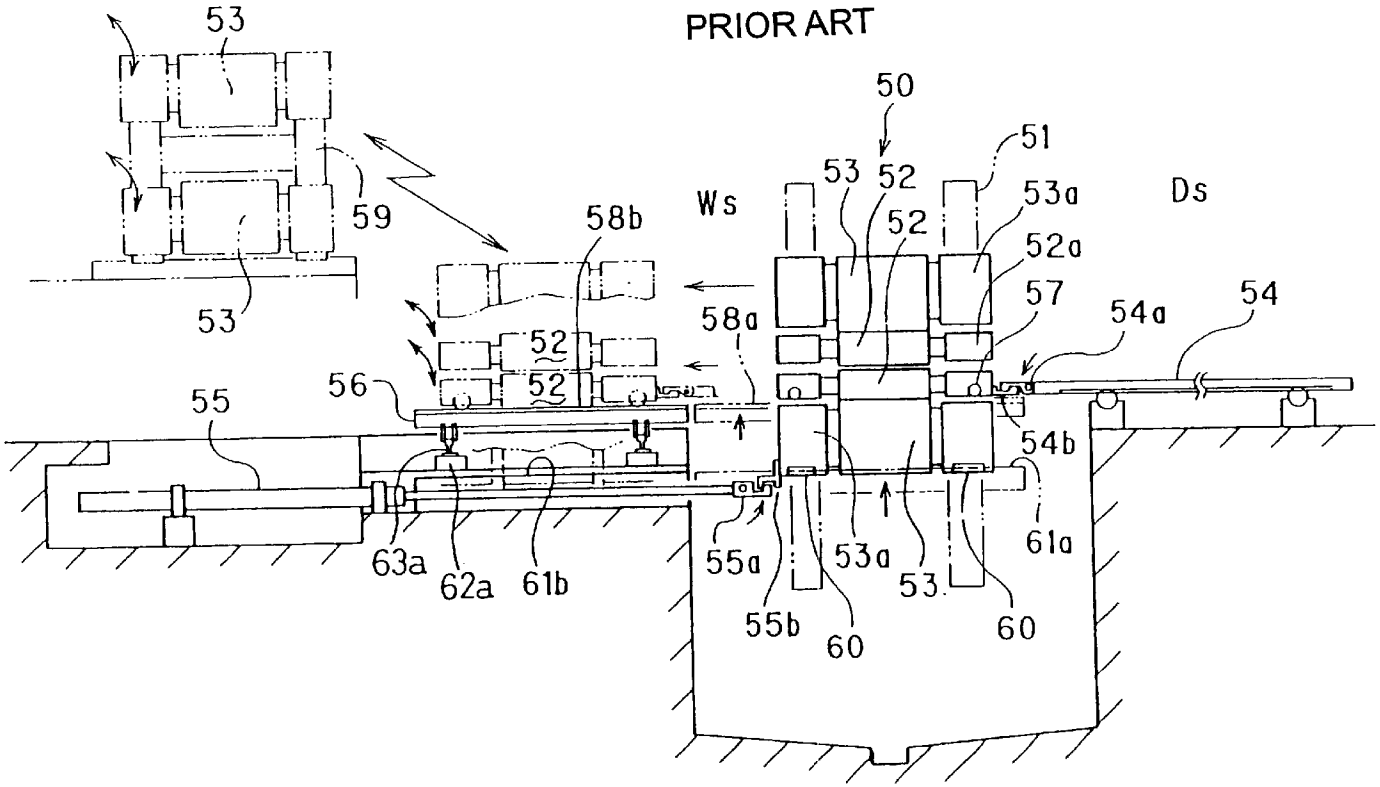
FIG. 16 PRIOR ART
FIG. 16 is a front view of a conventional side shift type roll changing apparatus.
Figure 17:
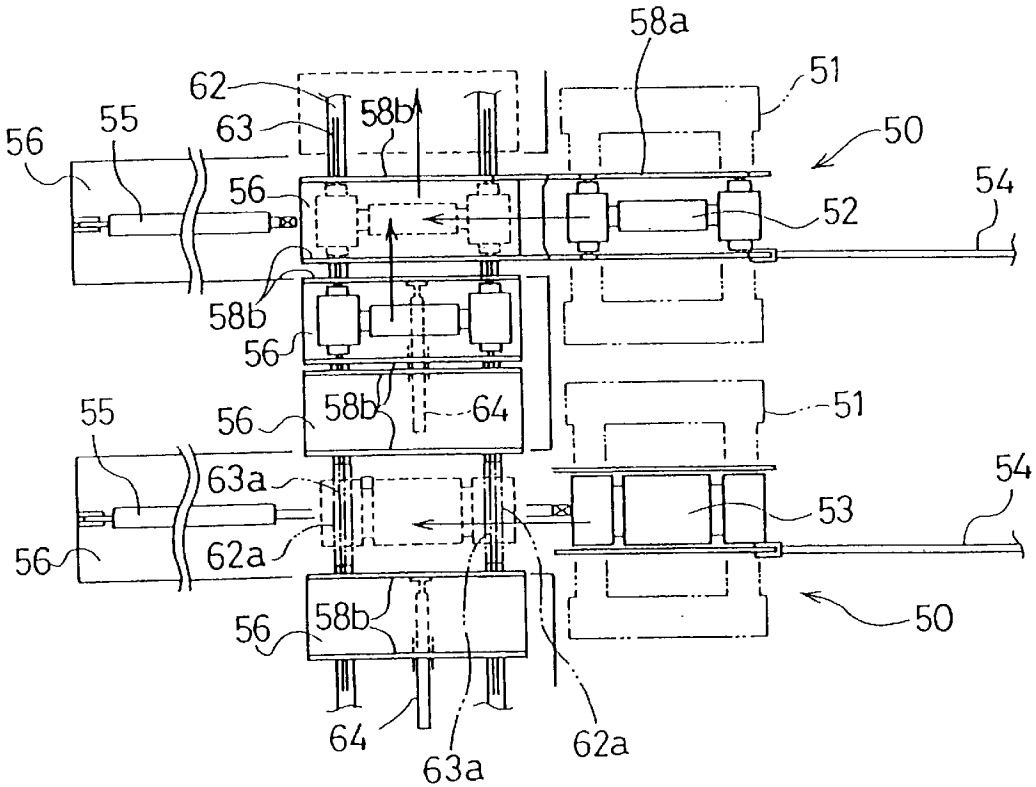
FIG. 17 PRIOR ART
FIG. 17 is a plan view of the conventional side shift type roll changing apparatus.
Figure 18:
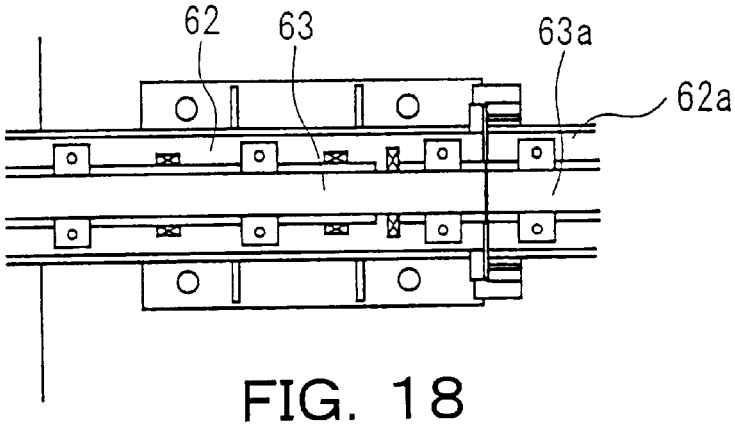
FIGS. 18(*a*) to 18(*c*) are detail drawings of a rail junction in the conventional side shift type roll changing apparatus.
Figure 18:
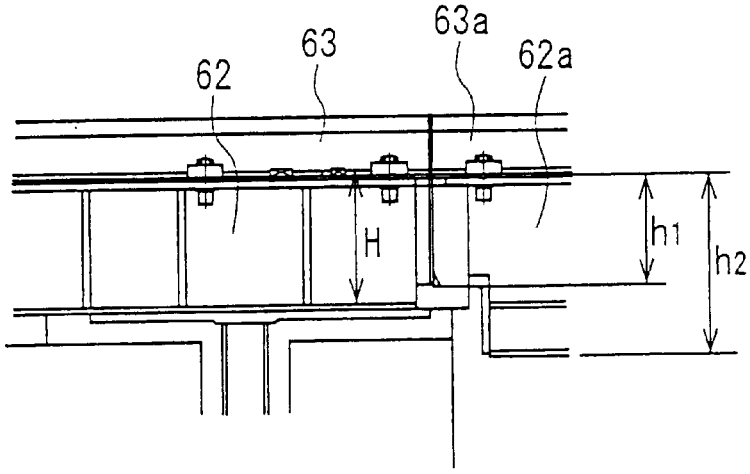
Figure 18:
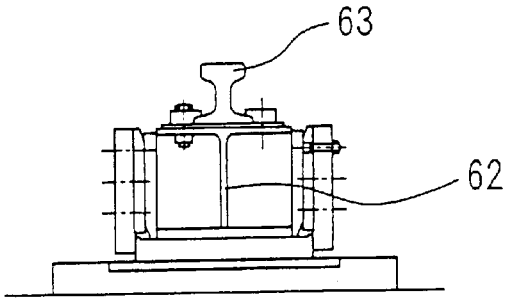

FIG. 1 is a front view of a four-high rolling mill according to a first embodiment of the present invention. FIG. 2 is a view taken on line II—II in FIG. 1. FIGS. 3(A) to 3(C) are explanation drawings of a roll changing procedure for the four-high rolling mill. In these drawings, the same members as in FIGS. 16 and 17 are assigned the same numerals, and duplicate explanations are omitted.

As shown in FIGS. 1 and 2, a conventional pusher 54 disposed on a drive side Ds of a rolling mill stand 51 serves to push out and pull in upper and lower work rolls 52 as a pair and upper and lower backup rolls 53 as a pair, and the lower backup roll 53 and a stool 59 for roll changing are provided with wheels. In this manner, a roll changing apparatus of a four-high rolling mill 50 is constituted in the present invention.

In the drawings, the numeral 12 denotes a drive cylinder for raising and lowering an up-and-down rail 58*a* in the rolling mill stand 51, 14 denotes a wheel provided on a lower backup roll chock 53*a*, 15 denotes a backup roll pushing-out/pulling-in up-and-down rail provided in the rolling mill stand 51, 16 denotes a drive cylinder for raising and lowering the up-and-down rail 15, 17*a* denotes a backup roll pulling-out pit, 17*b* denotes a channel-shaped pit formed adjacent to the backup roll pulling-out pit 17*a* and serving to lay girders 62 and rails 63, and 18 denotes a backup roll pushing-out/pulling-in fixed rail laid in the backup roll pulling-out pit 17*a*. The numeral 20 denotes a wheel provided in each of opposite end portions of the stool 59, and 59*a* denotes a connecting fitting provided in a lower end portion of the stool 59 facing the rolling mill.

Connecting fittings 54*b* and 59*a* of a lower work roll chock 52*a* and the stool 59, respectively, are provided so that when the lower work roll chock 52*a* and the stool 59 ride on the rails 58*a* in the rolling mill stand 51, which are adjusted to the same height as rails 58*b* on a shift table 56, the lower work roll chock 52*a* and the stool 59 retain positions on the same axis line as the pusher 54, and the lower work roll chock 52*a* and the stool 59 can be pushed out from and pulled in onto the rails 58*a* and the rails 58*b*.

Transfer of the roll assembly between the changing rails and the rolling mill during roll changing is performed in the following manner with the use of the drive cylinders 12 and 16: The rails 58*a* and the up-and-down rails 15 are slightly lowered from the height positions at the time of roll changing by operation of the drive cylinders 12 and 16, whereby the work roll 52 and the backup roll 53 are transferred into the rolling mill stand 51. Conversely, the rails 58*a* and the up-and-down rails 15 are raised to the above height positions, whereby the work roll 52 and the backup roll 53 are transferred from the rolling mill stand 51 to the rails 58*a* and the up-and-down rails 15. Other features are the same as in FIGS. 16 and 17.

To change the work rolls 52, the rails 58*a* in the rolling mill stand 51 are raised to the same height as the rails 58*b* on the shift table 56 to support the entire assembly of the upper and lower work rolls by the rails 58*a*. Then, the connecting fitting 54*a* at the tip of the pusher 54 is coupled to the connecting fitting 54*b* of the lower work roll chock 52*a*. Then, the pusher 54 is extendedly driven to push out the worn-out old work roll assembly onto the shift table 56, as shown in FIG. 3(A). Then, a new work roll assembly is attached to the tip of the pusher 54 on the shift table 56 that has been shifted. The new work roll assembly is pulled into the rolling mill stand 51. Then, the rails 58*a* are lowered to set the new work roll assembly from above the rails 58*a* to a predetermined position of the rolling mill stand 51.

To change the backup rolls 53, the shift table 56 loaded with the work roll assembly is laterally shifted and replaced by the shift table 56 loaded with the stool 59. The stool 59 is pulled into the rolling mill stand 51 by the pusher 54, as shown in FIG. 3(B). The shift table 56 unloaded or emptied in this state is retreated sideways from before the four-high rolling mill 50, and the shifting, detachable girders 62*a* and rails 63*a* are also temporarily removed from ahead of the four-high rolling mill 50.

Then, as shown in FIG. 3(C), the lower backup roll 53 is raised by the up-and-down rails 15, and combined with the stool 59. Then, the rails 58*a* are lowered, whereafter the upper backup roll 53 is lowered and integrated with the stool 59. The weight of the resulting assembly is supported on the up-and-down rails 15.

Then, the old backup roll assembly is pushed out by the pusher 54 via the stool 59, and replaced with a new backup roll assembly by a crane operation or the like outside the four-high rolling mill 50. Then, the new backup roll assembly is pulled into the four-high rolling mill 50, and the new upper and lower backup rolls 53 are set in place in the rolling mill stand 51 by the same procedure performed in the reverse order.

During this period, the detachable girders 62*a* and rails 63*a* and the shift table 56, which have been temporarily removed, are restored to the original state. Only the stool 59 is pushed out and removed onto the shift table 56 on the work side Ws by the action of the pusher 54. The pusher 54 is returned to the pulled-in position, when changing of the backup rolls 53 is completed. Subsequently, the new work roll assembly is assembled to the new backup rolls 53 to complete the roll replacing operation.

According to the foregoing features, the roll changing stool 59 is wheel-equipped, and can be directly connected to the pusher 54. Thus, the pushing-out/pulling-in procedure by the pusher 54 during backup roll changing is decreased by one reciprocation (four reciprocations minus three reciprocations) as compared with the conventional apparatus of FIGS. 16 and 17. This means a saving in labor.

Furthermore, the single pusher 54 can be used for both purposes, changing of the work rolls 52 and changing of the backup rolls 53, and can omit the conventional hydraulic cylinder 55 for backup rolls. Thus, the fixtures cost can be reduced markedly, and it becomes unnecessary to construct foundations, such as the pit, which are formed for accommodating the hydraulic cylinder 55.

Particularly in the case of modification of the existing equipment, for example, in the case of modification of old-fashioned rolling equipment, which changes rolls by pulling out them by a C-hook of a crane and pulling in new rolls, into the above-described changing system using the pusher 54, the conventional backup roll pulling-out pit portion can be effectively used, unchanged, for modification. This results in marked shortening of the construction period and a marked decrease in the cost of modifying the foundations.

Second Embodiment

Figure 4:
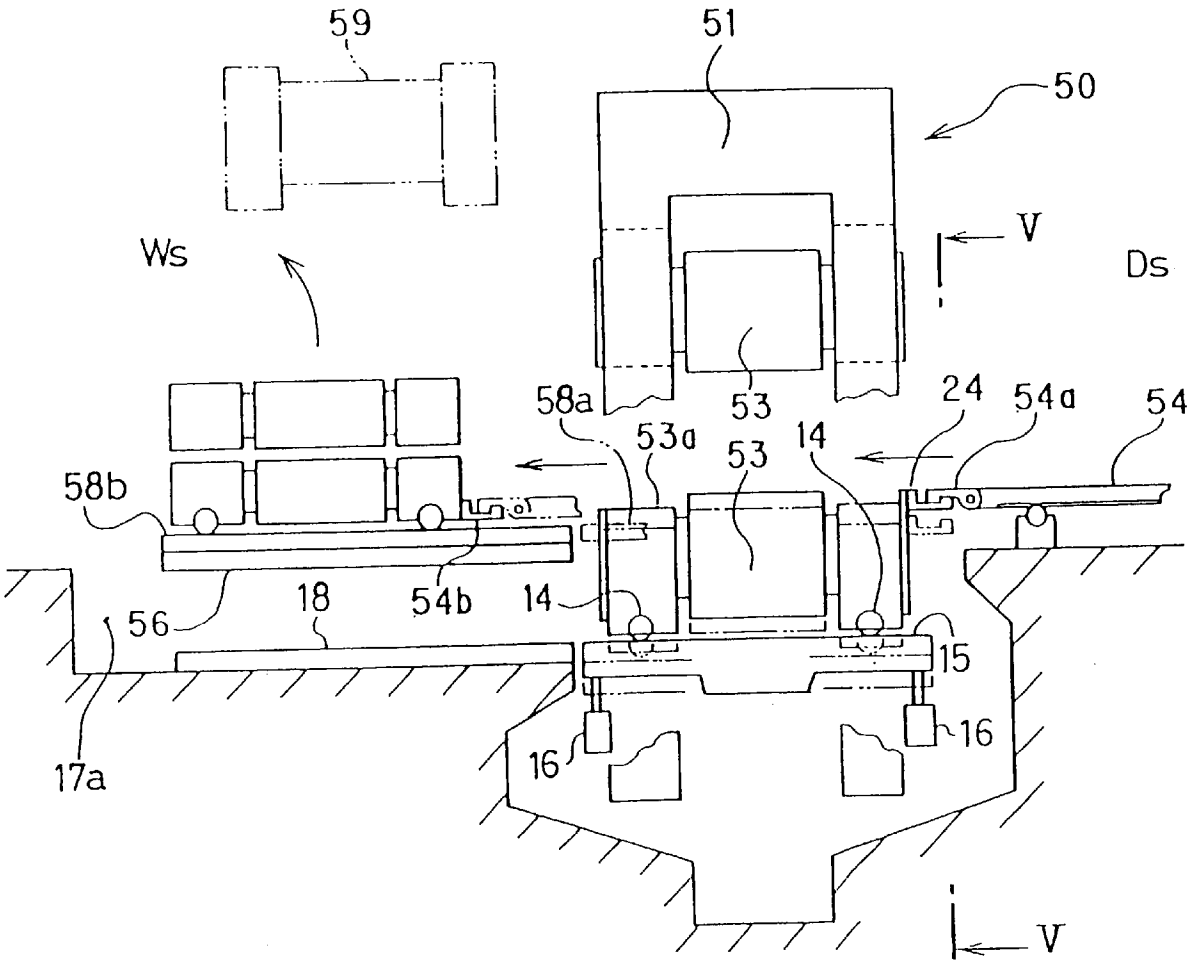
FIG. 4 is a front view of a four-high rolling mill according to a second embodiment of the present invention.
Figure 5:
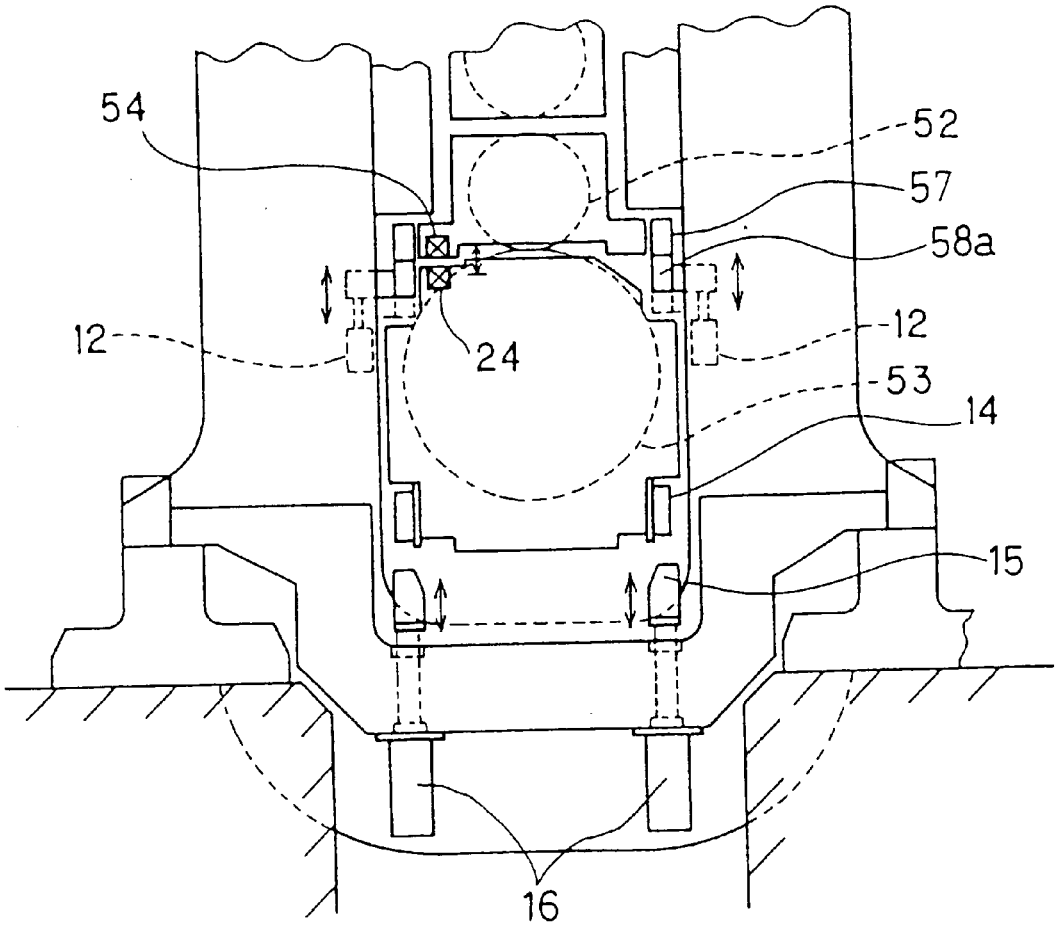
FIG. 5 is a view taken on line V—V in FIG. 4.

FIG. 4 is a front view of a four-high rolling mill according to a second embodiment of the present invention. FIG. 5 is a view taken on line V—V in FIG. 4. FIGS. 6(A) to 6(D) are explanation drawings of a roll changing procedure for the four-high rolling mill.

This embodiment is designed such that the roll changing stool is a conventional type without wheels, a connecting portion for connection with a pusher is provided at the upper end of a wheeled lower backup roll chock, a lower backup roll is supported on up-and-down rails within a rolling mill stand, the lower backup roll is raised to a height at which the lower backup roll is connectable with the pusher for changing of the backup rolls, the lower backup roll at the raised position is pushed out and pulled in between the inside of the rolling mill stand and rails on the work side by the pusher, and the single pusher serves for both of changing of the work rolls and changing of the backup rolls.

As shown in FIGS. 4 and 5, the wheels 20 of the stool 59 in the First Embodiment have been decommissioned, and a connecting fitting 24 is provided at an upper part of the end surface of the lower backup roll chock 53*a*. Other features are the same as in the First Embodiment.

Figure 6A:
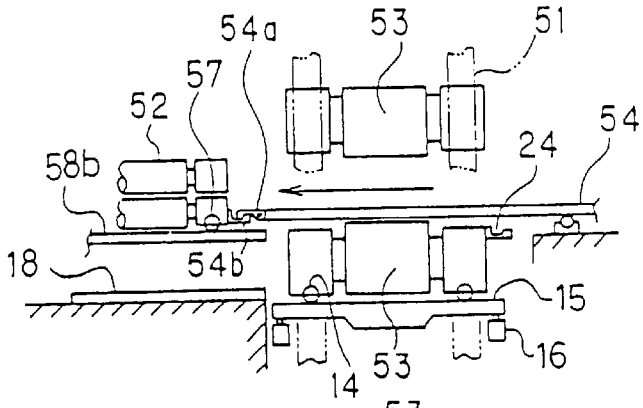
FIGS. 6(A) to 6(D) are explanation drawings of a roll changing procedure for the four-high rolling mill.

Because of the above configuration, changing of work rolls 52 is performed by coupling a connecting fitting 54*a* of a pusher 54 to a connecting fitting 54*b* of a lower work roll chock 52*a* at a position at which rails 58*a* in a rolling mill stand 51 have been raised to the same height as rails 58*b* on a shift table 56, as shown in FIG. 6(A), and performing the extended and contracted drive of the pusher 54. This is the same as in the First Embodiment.

Changing of backup rolls 53 is performed after pushing out a work roll assembly from inside the rolling mill onto the shift table 56 by the pusher 54, shifting the work roll assembly sideways for retreat, returning the pusher 54 to the original position, and temporarily removing the shift table 56 and detachable shifting girders 62*a* and rails 63*a* (see FIG. 1) from before the rolling mill.

Figure 6B:
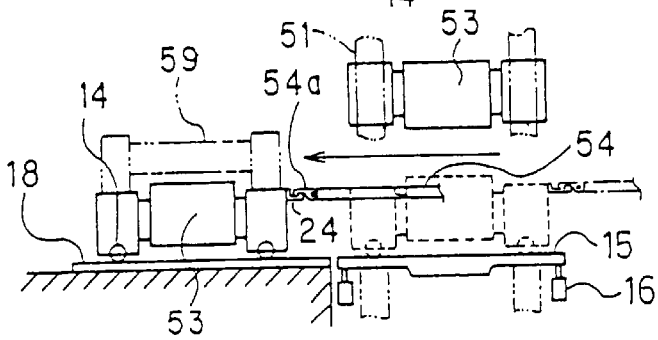

In this state, up-and-down rails 15 are raised to the same height as fixed rails 18 laid inside a backup roll pulling-out pit 17*a* on a work side Ws by operation of drive cylinders 16, coupling the connecting fitting 24 of the lower backup roll chock 53*a* to the connecting fitting 54*a* of the pusher 54, pushing out the lower backup roll 53 having the lower backup roll chocks 53*a* onto the fixed rails 18 on the work side Ws by the extended drive of the pusher 54, and mounting a conventional wheel-less roll changing stool 59 on the lower backup roll chocks 53*a* of the pushed-out lower backup roll 53, as shown in FIG. 6(B).

Figure 6C:
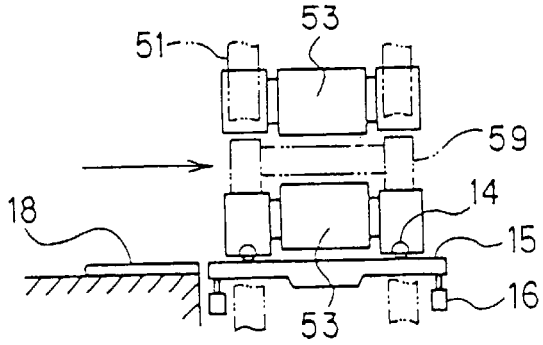

Then, the lower backup roll 53 having the lower backup roll chocks 53*a* mounted with the roll changing stool 59 is pulled into the rolling mill stand 51 by the pusher 54, as shown in FIG. 6(C).

Figure 6D:
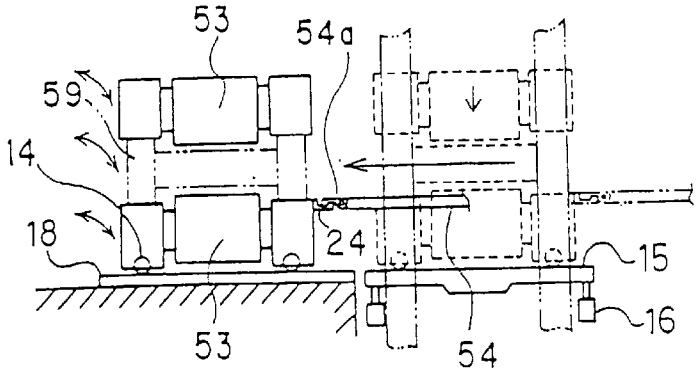

Then, the upper backup roll 53 provided with the upper backup roll chocks 53*a* is lowered and integrated onto the roll changing stool 59. The upper and lower backup rolls 53 are pushed out onto the fixed rails 18 on the work side Ws by the pusher 54, as shown in FIG. 6(D). At this position, the upper backup roll 53 with the upper backup roll chocks 53*a* is replaced by a new upper backup roll 53.

The assembly, in which replacement of the upper backup roll 53 with the upper backup roll chocks 53*a* has been finished in the state of FIG. 6(D), is pulled into the rolling mill stand 51 as shown in FIG. 6(C). The new upper backup roll 53 with the new upper backup roll chocks 53*a* is set in the rolling mill stand 51. Then, the roll changing stool 59 and the lower backup roll 53 with the lower backup roll chocks 53*a* are pushed out again onto the fixed rails 18 on the work side Ws, as shown in FIG. 6(B), and the roll changing stool 59 is removed. Then, the lower backup roll 53 with the lower backup roll chocks 53*a* is replaced by a new lower backup roll 53 with new lower backup roll chocks 53*a*, and only the new lower backup roll 53 with the new lower backup roll chocks 53*a* is pulled into the rolling mill stand 51. The new lower backup roll 53 with the new lower backup roll chocks 53*a* is disconnected from the pusher 54, and the up-and-down rails 15 are lowered to set the lower backup roll 53 with the lower backup roll chocks 53*a* in place in the rolling mill stand 51, thereby completing changing of the backup rolls.

According to this embodiment, the roll changing stool 59 of the conventional type is used, so that the number of the pushing-out and pulling-in steps during backup roll changing is the same as in the earlier technologies. However, the single pusher 54 can be used concurrently for changing of the work rolls and changing of the backup rolls. In this respect, the same effects as in the First Embodiment can be obtained.

Third Embodiment

Figure 7:
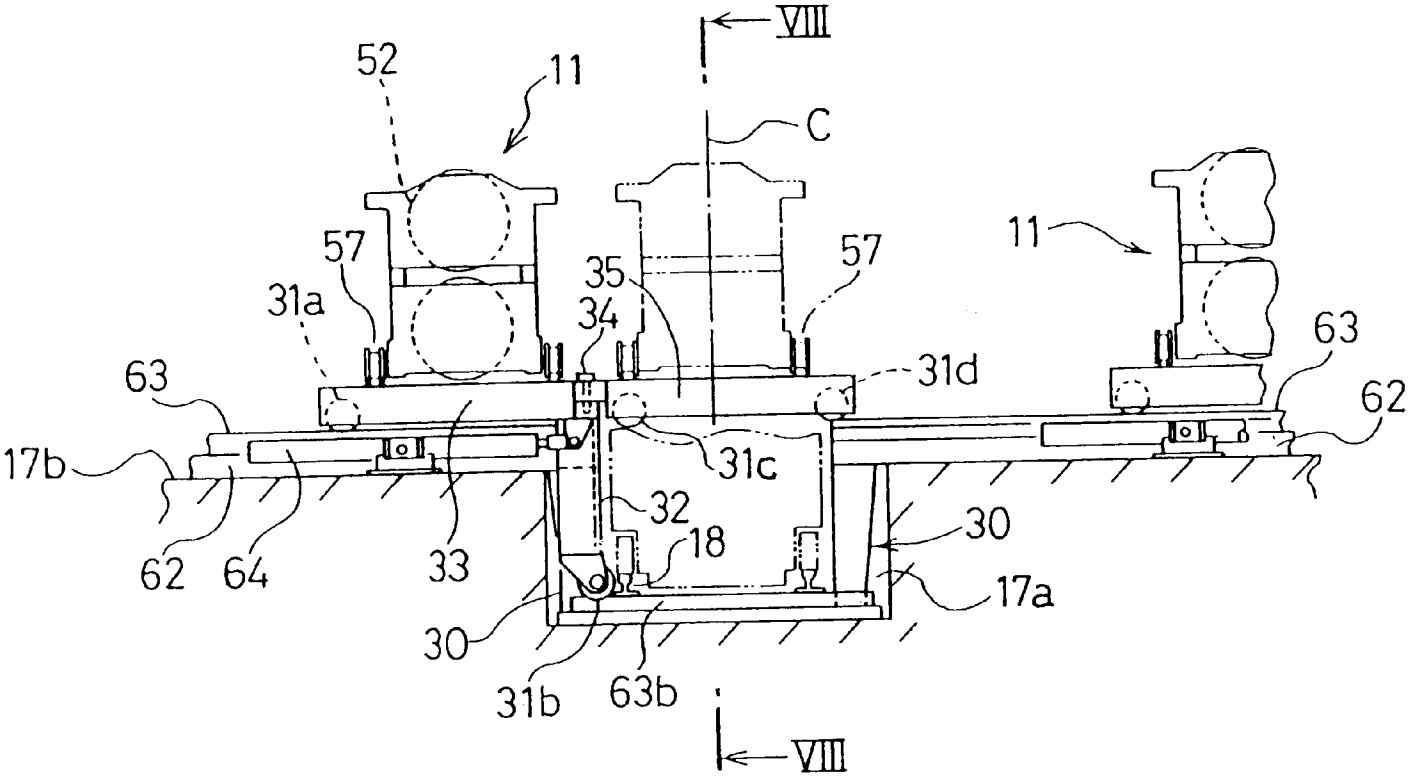
FIG. 7 is a side view of a roll changing apparatus according to a third embodiment of the present invention.
Figure 8:
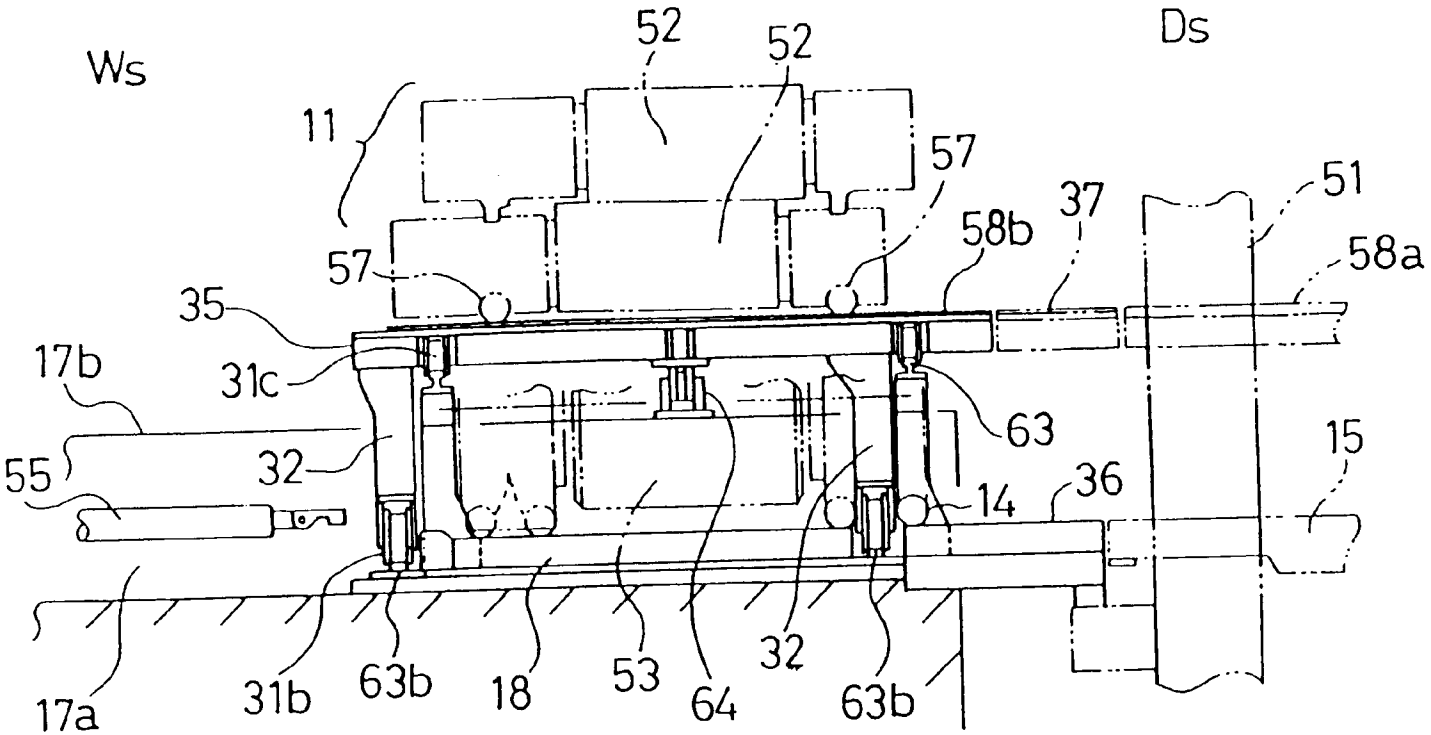
FIG. 8 is a view taken on line VII—VII in FIG. 7.
Figure 9:
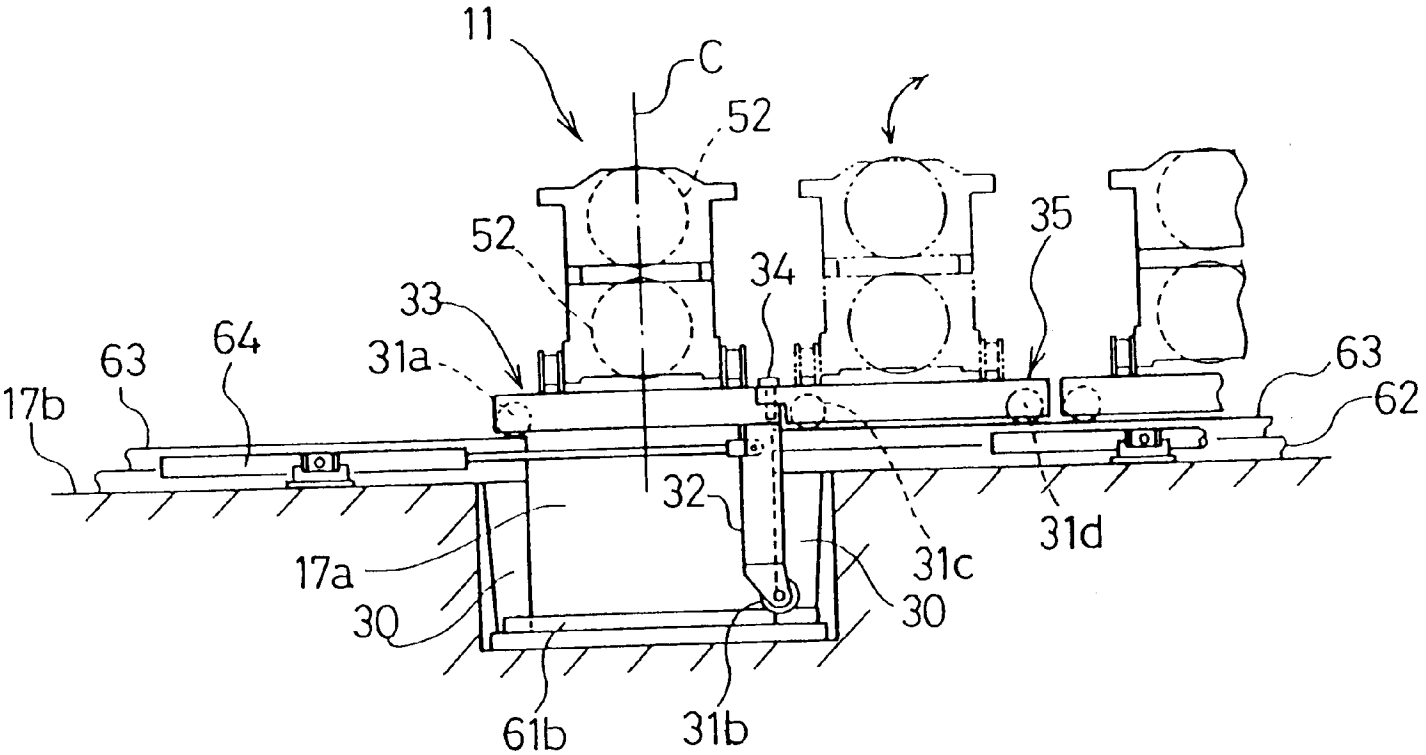
FIG. 9 is an operating state view during work roll changing by the roll changing apparatus.
Figure 10:
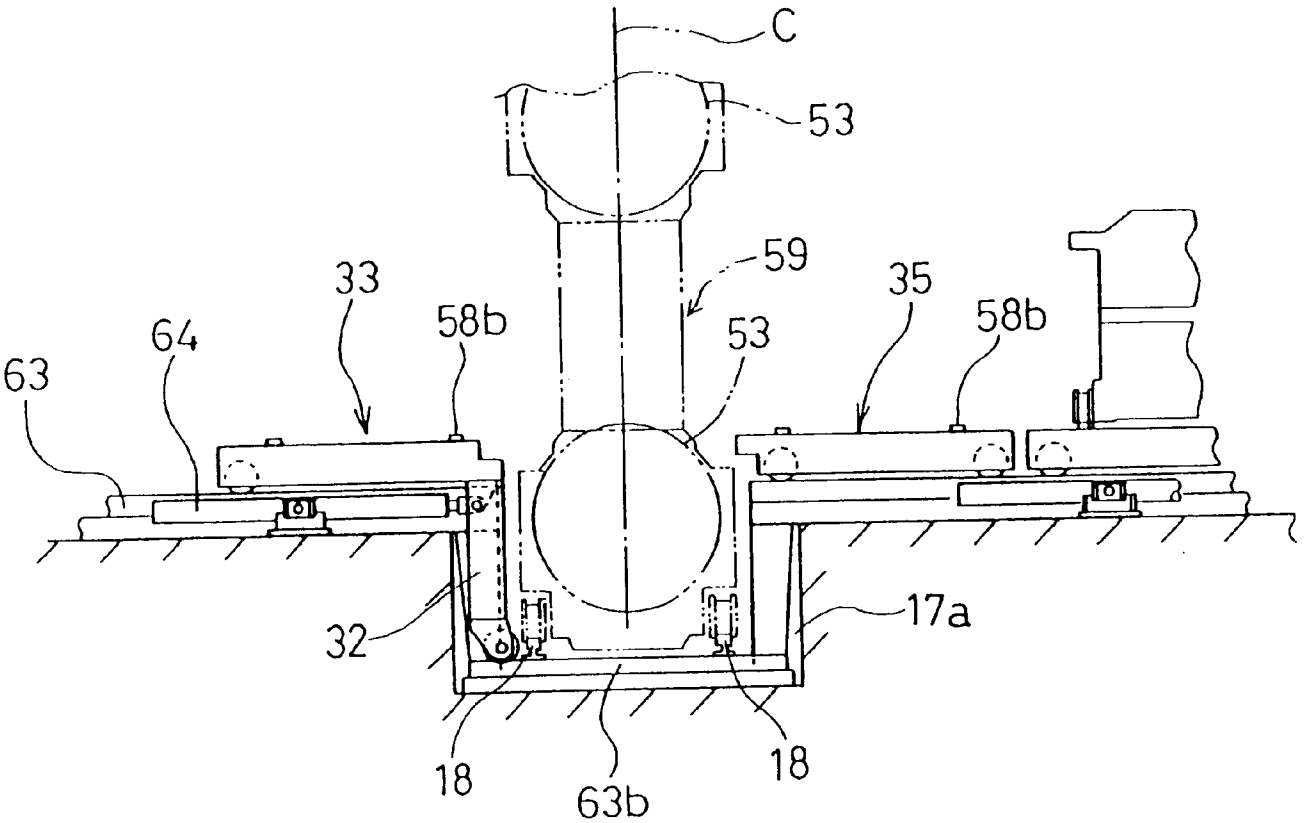
FIG. 10 is an operating state view during backup roll changing by the roll changing apparatus.

FIG. 7 is a side view of a roll changing apparatus according to a third embodiment of the present invention. FIG. 8 is a view taken on line VII—VII in FIG. 7. FIG. 9 is an operating state view during work roll changing by the roll changing apparatus. FIG. 10 is an operating state view during backup roll changing by the roll changing apparatus.

In FIGS. 7 and 8, C denotes a roll pullout center position of a rolling mill viewed from its side, 11 denotes a work roll assembly to be replaced, 17*a* denotes a backup roll pulling-out pit formed on the work side in alignment with the position of the rolling mill, and 17*b* denotes a channel-shaped pit for roll changing apparatus installation formed on the work side Ws of the rolling mill.

The present roll changing apparatus includes rails (floor rail portion) 63 laid on the channel-shaped pits 17*b* located ahead of and behind the backup roll pulling-out pit 17*a* dividedly in the shifting direction, i.e., discontinuously so as not to be an impediment during replacement (incoming and outgoing) of a backup roll assembly to be described later on; and rails (pit bottom rail portion) 63*b* located between these rails 63 and laid at the bottom of the backup roll pulling-out pit 17*a* so as to cover the discontinuous portions of the rails 63. That is, the rails 63 and 63*b* are laid at different heights (with a step therebetween) in the shifting direction. In the illustrated embodiment, the rails 63 are laid on girders 62 having end portions, which face the pit 17*a*, supported on strut members 30 erected at front and rear bottom portions of the interior of the pit 17*a*. When the strength of the girders 62 for laying the rails is increased, the strut members 30 supporting the end portions of the girders 62 (facing and entering the pit 17*a*) can be omitted.

The present roll changing apparatus also includes a shifting cylinder 64 located between the right and left rails 63 as a pair, supported on the channel-shaped pit 17*b* ahead of the pit 17*a*, and having a drive end facing a site above the pit 17*a*; a trolley-shaped first shift table 33 provided so as to have one end carried on the rails 63 ahead of the pit 17*a* via wheels 31*a*, and the other end carried on the rails 63*b* in the pit 17*a* via legs 32 and wheels 31*b*, and having a pit-facing end portion connected to the drive end of the shifting cylinder 64; a second shift table 35 constituted so as to have one end connected to and supported on the pit-facing end portion of the first shift table 33 by bolts 34 or the like, and provided at opposite end portions with wheels 31*c*, 31*d* capable of contacting an upper part of the rails 63 behind the pit 17*a*; and work roll pulling-out rails 58*b* provided on the first and second shift tables 33 and 35.

In the drawings, 18 denotes a fixed rail laid between the right and left rails 63*b* as a pair so as to be cable of pulling out the backup roll 53 to the bottom of the pit 17*a* at a higher position than the rails 63*b*, 15 denotes a backup roll pulling-out up-and-down rail within a rolling mill stand 51, and 36 denotes a backup roll pulling-out rail placed between the rails 63*b* near the rolling mill and the up-and-down rails 15 within the rolling mill stand 51. A region between the fixed rails 18 and the rails 36 is constituted discontinuously by a predetermined gap to be crossed by the rail 63*b*. The numeral 14 denotes a wheel provided on the lower backup roll chock so as to permit passage over the gap between the fixed rails 18 and the rails 36. Two of the wheels 14 are provided for each lower backup roll chock.

The numeral 58*a* denotes a work roll pulling-out rail provided within the rolling mill stand 51 in correspondence with the work roll pulling-out rail 58*b* on the first and second shift tables 33 and 35, and the numeral 37 denotes a work roll pulling-out rail placed as a connection between the rails 58*a* and 58*b*.

The so constituted roll changing apparatus is provided in the same configuration, with the fixed rails 63 on the floor being shared by the respective four-high rolling mills on the rolling line. Other features are the same as in FIGS. 16 and 17, so that duplicate explanations will be omitted with reference to FIGS. 16 and 17.

According to the foregoing configuration, the first and second shift tables 33 and 35 of the roll changing apparatus corresponding to the rolling mill are connected by the bolts 34 or the like, and used for work roll changing, as shown in FIG. 7.

As an example, a spare new work roll assembly 11 is loaded on the first shift table 33, and the second shift table 35 is emptied. In this state, the shifting cylinder 64 is contractedly driven to a set position, whereby the second shift table 35 is stopped in alignment with the roll pullout center position C of the rolling mill.

At this time, the first shift table 33 shifts in a nearly horizontal state such that its end portion facing the pit 17*a*, which has been connected to the shifting cylinder 64, rides on the rails 63*b* within the pit 17*a* via the legs 32 and wheels 31*b*, while the opposite end portion of the first shift table 33 rides on the rails 63 ahead of the pit 17*a* via the wheels 31*a*. Simultaneously, the second shift table 35 similarly shifts in a nearly horizontal state such that its connected end side is supported by the end portion of the first shift table 33, and its opposite end portion rides on the rails 63 behind the pit 17*a* via the wheels 31*d*.

Then, as shown in FIG. 8, the worn-out old work roll assembly within the rolling mill stand 51 is pushed out onto the second shift table 35 by the pusher 54 (see FIGS. 16 and 17).

Then, as shown in FIG. 9, the shifting cylinder 64 is extendedly driven to a set stroke position, whereby the first shift table 33 is stopped in alignment with the roll pullout center position C of the rolling mill. At this time, the second shift table 35 shifts such that its connected end side is supported by the end portion of the first shift table 33, and its opposite end portion rides on the rails 63 behind the pit 17*a* via the wheels 31*d*. As a result, both ends of the second shift table 35 ride on the rails 63 behind the pit 17*a* via the wheels 31*c* and 31*d*, at the stop position where the first shift table 33 aligns with the roll pullout center position C. Thus, the first shift table 33 is movable only within the range of the length of the rail 63*b* in the pit 17*a*.

In this condition, the new work roll assembly 11 on the first shift table 33 is pulled into the rolling mill stand 51 by the pusher 54 to carry out work roll changing.

For backup roll changing, the following actions take place as an example: In the state of FIG. 9, the work roll assembly 11 in the rolling mill stand 51 is pulled out onto the first shift table 33, and the work roll assembly 11 is retreated to the nearest position by a crane or the like to empty the shift tables 33 and 35. Then, the bolts 34 between the first and second shift tables 33 and 35 are detached to disconnect the first and second shift tables 33 and 35. Then, as shown in FIG. 10, only the first shift table 33 is shifted forwardly of the pit 17*a* by the contracted driving of the shifting cylinder 64, whereby an open space necessary for pulling-out of the backup roll 53 is formed above the center in the pit 17*a*.

From the above state, the lower backup roll 53 is once pulled out of the rolling mill stand 51 into the space within the pit 17*a* by use of the roll changing hydraulic cylinder 55. The roll changing stool 59 is mounted on the pulled-out lower backup roll 53, and the lower backup roll 53 mounted with the roll changing stool 59 is returned again into the rolling mill stand 51. Then, the upper backup roll 53 is placed on the stool 59, and a combination of the lower and upper backup rolls 53 and the stool 59 is pulled out into the pit 17*a*. The upper and lower backup rolls are replaced by new upper and lower backup rolls, and then the new upper and lower backup rolls are assembled into the rolling mill stand 51 by the same procedure.

According to the present embodiment, as described above, the side shifting rail structure of the backup roll pulling-out pit 17*a* has been changed from a detachably constructed system to a fixedly laid system. Thus, the structure can be simplified and downsized, so that the expenses and construction period for modification can be reduced, and labor for maintenance and administration can be decreased. Particularly when the channel-shaped pit 17*b* is formed, its depth can be decreased.

In changing the backup rolls, moreover, the conventional operation for mounting and dismounting the rails for the shift table is unnecessary, and thus can markedly shorten the time for the changing operation. Furthermore, when the backup roll 53 is to be pulled out by wheels, the present embodiment can be easily applied.

According to the present embodiment, the second shift table 35 is detachably attached to the first shift table 33, and the rails 63 are disposed on the floors ahead of and behind the pit 17*a*. Thus, the two shift tables can be alternately aligned with and stopped at the position of the roll axis line of the rolling mill, achieving rapidity of the changing operation.

Fourth Embodiment

Figure 11:
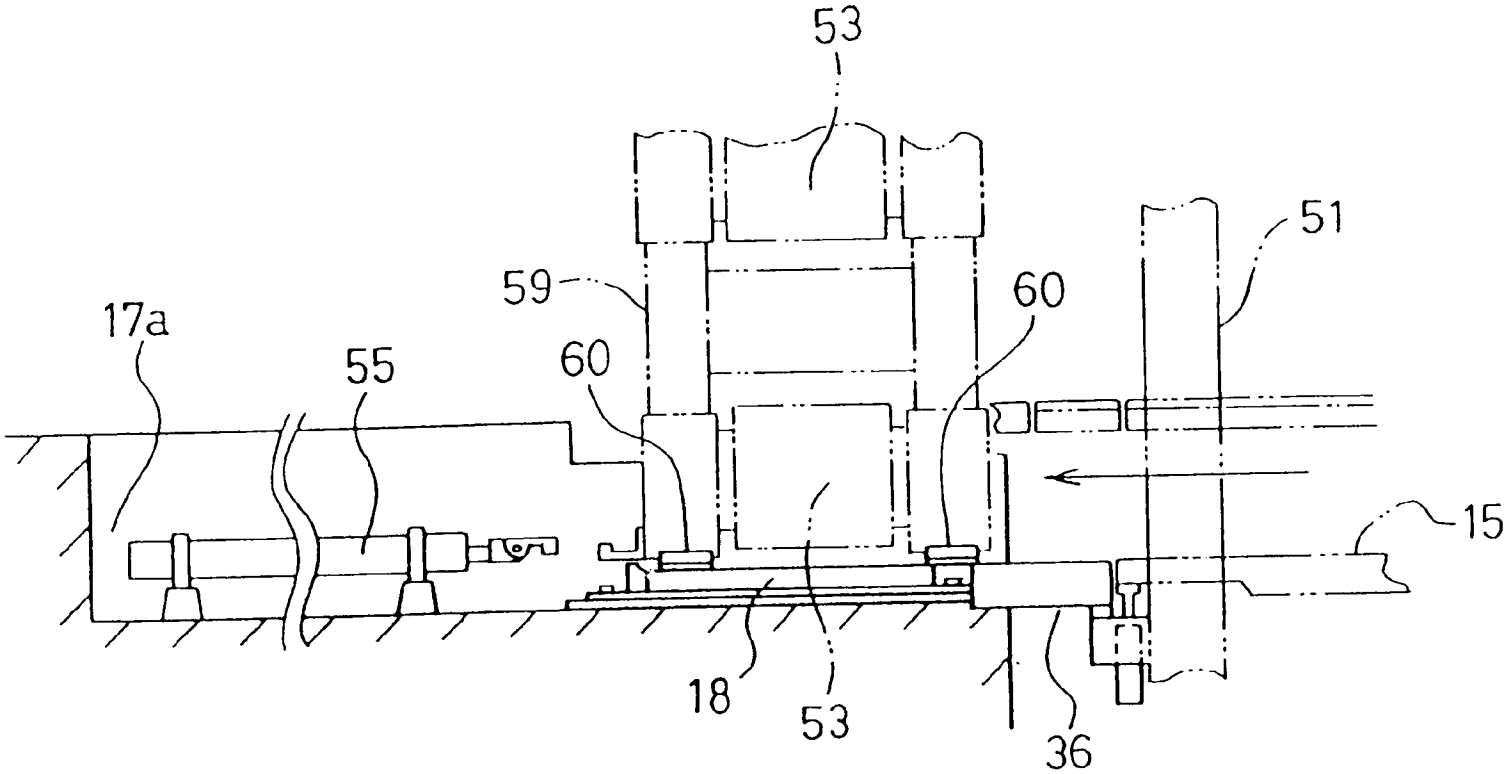
FIG. 11 is a front view of a roll changing apparatus according to a fourth embodiment of the present invention.

FIG. 11 is a front view of a roll changing apparatus according to a fourth embodiment of the present invention.

This embodiment is an embodiment in which slide members 60, such as sliding shoes, are provided at lower portions of lower backup roll chocks of a rolling mill in correspondence with the backup roll pulling-out rails 18, 15, 36 provided discontinuously in the pit 17*a*, etc. in the Third Embodiment, and a lower backup roll 53 pulled out or pushed in by a hydraulic cylinder 55 slidingly moves over the gaps between the discontinuous backup roll pulling-out rails 18, 15 and 36 by the action of the slide members 60.

According to the present embodiment, the length of the surface of contact of the slide member 60 with the rail is rendered greater than the gap between the rail 18 and the rail 36. By so doing, the lower backup roll 53 can be smoothly moved slidably on the discontinuous rails 18 and 36 via the slide members 60, and can be pulled out of or pushed into the rolling mill stand 51.

Fifth Embodiment

Figure 12:
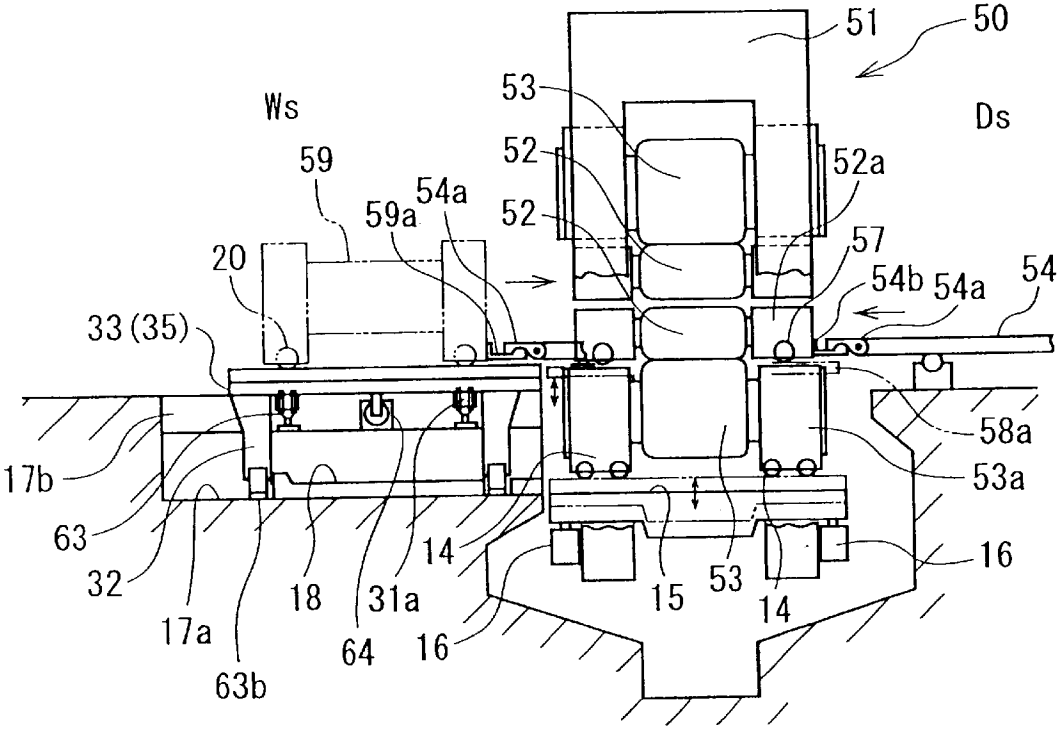
FIG. 12 is a front view of a roll changing apparatus according to a fifth embodiment of the present invention.

FIG. 12 is a front view of a roll changing apparatus according to a fifth embodiment of the present invention.

This embodiment is a combination of the First Embodiment and the Third Embodiment. That is, the conventional pusher 54 disposed on the drive side Ds of the rolling mill stand 51 serves both for pushing-out and pulling-in of the upper and lower work rolls 52 and backup rolls 53 as pairs, and the lower backup roll 53 and the roll changing stool 59 are provided with wheels, thereby constituting the roll changing apparatus for the four-high rolling mill 50. The roll changing apparatus also includes the first and second shift tables 33 and 35 capable of aligning with the roll axis line position C of the rolling mill (see FIG. 7), and the shifting rails 63 and 63*b* provided dividedly in the shifting direction at the bottoms of the channel-shaped pit 17*b* and the backup roll pulling-out pit 17*a*, respectively, in order to support the first and second shift tables 33 and 35 at the required height. The first shift table 33 is adapted to be shifted nearly horizontally within the pit 17*a* by the shifting cylinder 64 while extending over the rails 63 and 63*b*.

According to this embodiment, the conventional hydraulic cylinder 55 for the backup rolls can be omitted. Thus, the fixtures cost can be reduced markedly, and it becomes unnecessary to construct foundations, such as the pit, which are formed for accommodating the hydraulic cylinder 55. In addition, the side shifting rail structure of the backup roll pulling-out pit 17*a* has been changed from a detachably constructed system to a fixedly laid system. Thus, the structure can be simplified and downsized, and particularly when the channel-shaped pit 17*b* is formed, its depth can be decreased. Consequently, the expenses and construction period for modification can be reduced markedly.

Sixth Embodiment

Figure 13:
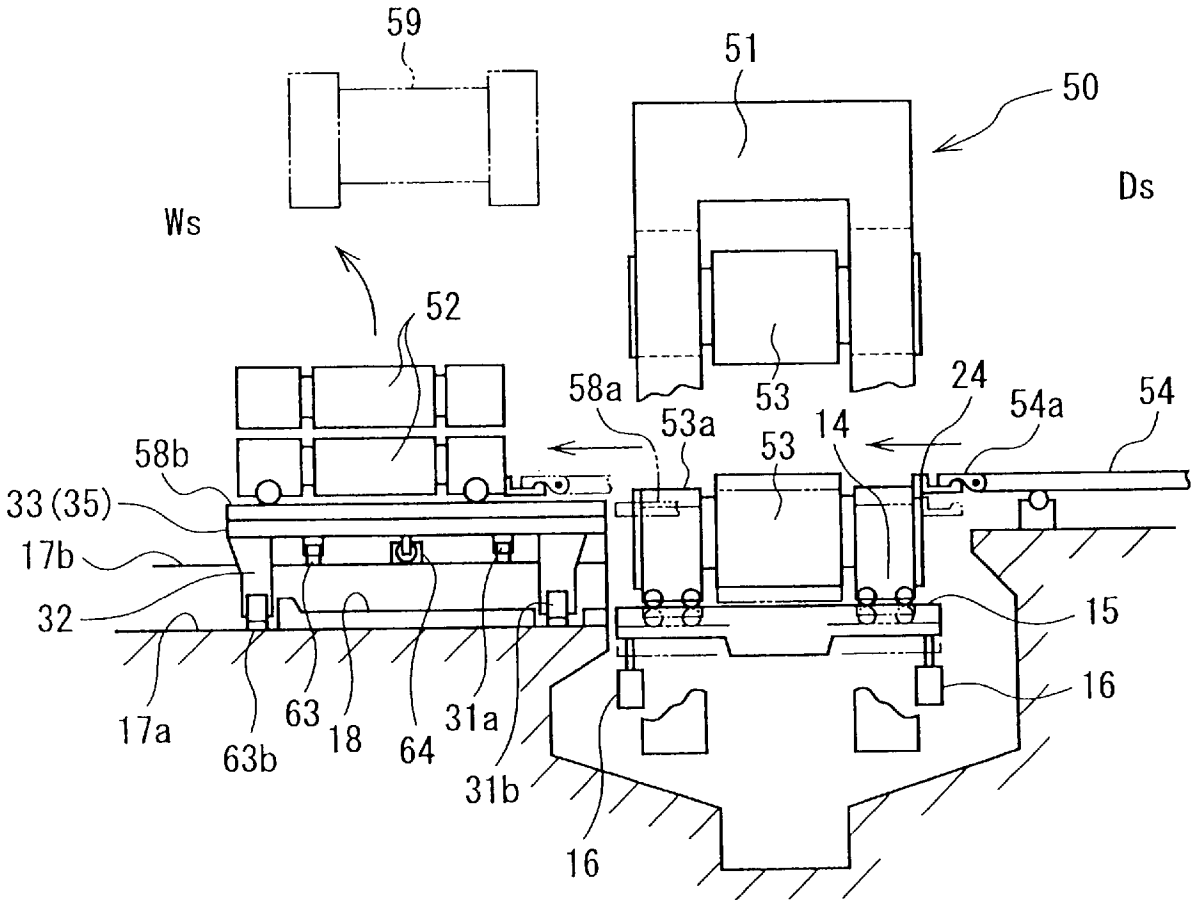
FIG. 13 is a front view of a roll changing apparatus according to a sixth embodiment of the present invention.
Figure 14:
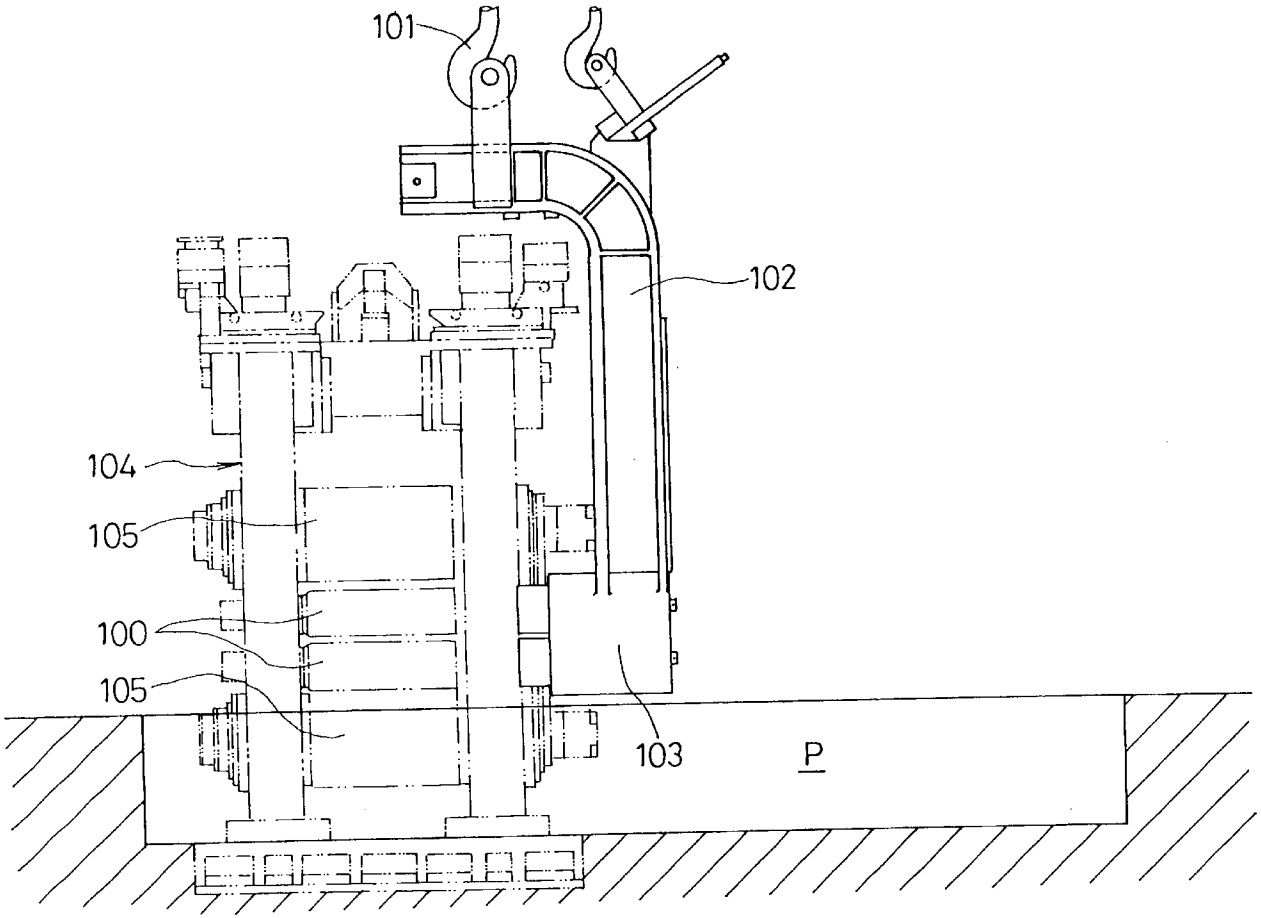
FIG. 14 is a front view of a conventional C-hook type roll changing apparatus.
Figure 15:
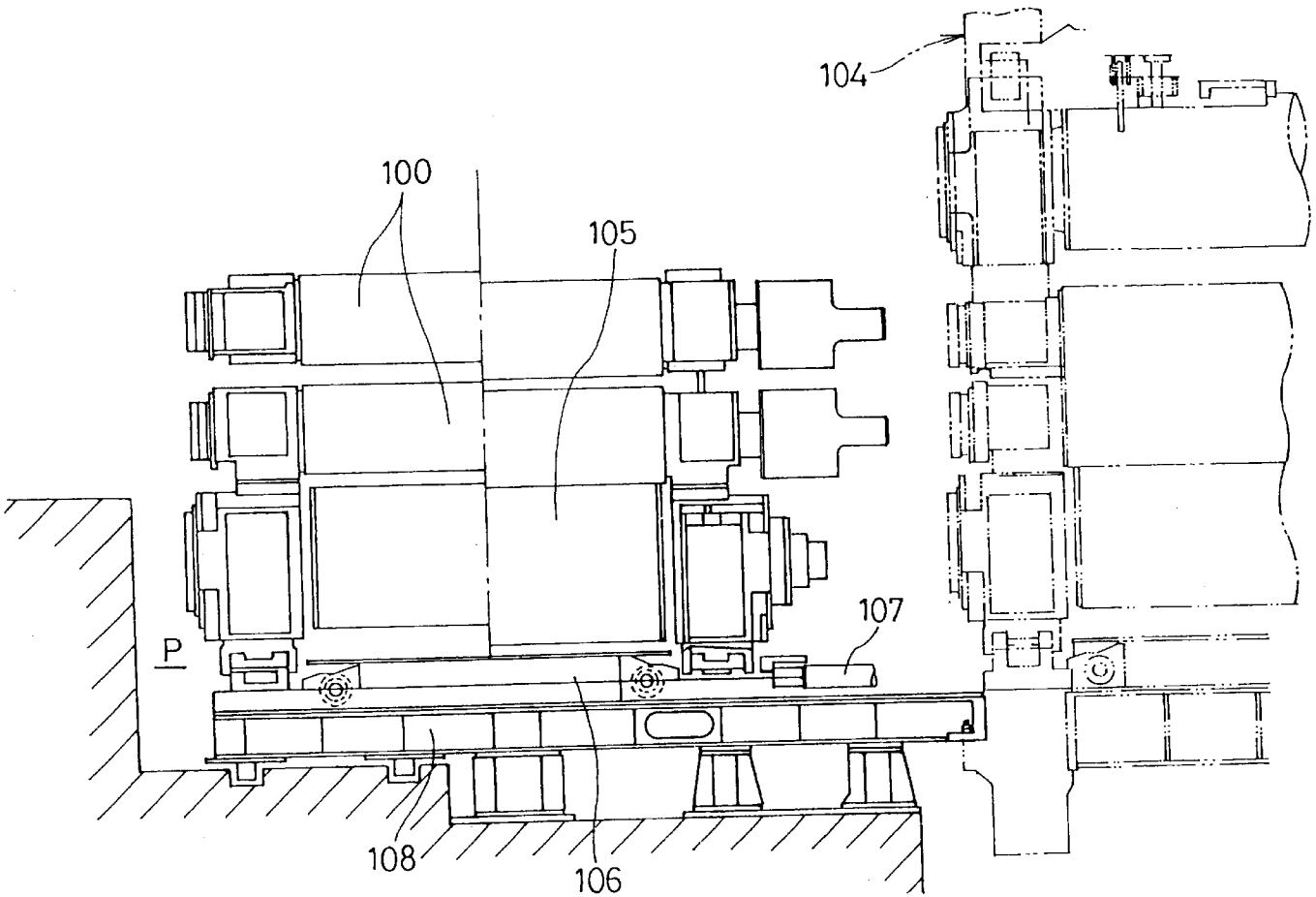
FIG. 15 is a front view of a conventional cluster type roll changing apparatus.

FIG. 13 is a front view of a roll changing apparatus according to a sixth embodiment of the present invention.

This embodiment is a combination of the Second Embodiment and the Third Embodiment. That is, the present embodiment is constituted in the following manner: The roll changing stool 59 is a wheel-less conventional type. The connecting fitting 24 for connection with the pusher 54 is provided at the upper end of the wheeled lower backup roll chock 53*a*. The lower backup roll 53 is supported on the up-and-down rail 15 within the rolling mill stand 51. The lower backup roll 53 is pushed out from the rails within the rolling mill stand 51 onto the rails on the work side Ws by the pusher 54 and pulled in from the latter rails onto the former rails by the pusher 54, at a position where the lower backup roll 53 has been raised to a height at which the lower backup roll 53 is connectable with the pusher 54 for backup roll changing. The single pusher 54 serves to change the work rolls 52 and the backup rolls 53. The roll changing apparatus also includes the first and second shift tables 33 and 35 capable of aligning with the roll axis line position C of the rolling mill (see FIG. 7), and the shifting rails 63 and 63*b* provided dividedly in the shifting direction at the bottoms of the channel-shaped pit 17*b* and the backup roll pulling-out pit 17*a*, respectively, in order to support the first and second shift tables 33 and 35 at the required height. The first shift table 33 is adapted to be shifted nearly horizontally within the pit 17*a* by the shifting cylinder 64 while extending over the rails 63 and 63*b*.

According to this embodiment, like the Fifth Embodiment, the fixtures cost can be reduced markedly. Besides, the side shifting rail structure of the backup roll pulling-out pit 17*a* can be simplified and downsized, and the expenses and construction period for modification can be reduced markedly.

While the present invention has been described by the foregoing embodiments, it is to be understood that the invention is not limited thereby, but various changes and modifications may be made without departing from the gist of the present invention. For example, in the First Embodiment, etc., the roll changing stool 59 and the lower backup roll chock 53*a* need not have the wheels 20, 14, but may be those which are movable. In the Third Embodiment, etc., there may be only one shift table, instead of the two shift tables 33 and 35. Such variations are not to be regarded as a departure from the spirit and scope of the invention, and all such modifications as would be obvious to one skilled in the art are intended to be included within the scope of the appended claims.

What is claimed is:

1. A roll changing apparatus for a rolling mill, comprising:

rails, provided in a stand of the rolling mill and on a work side of the rolling mill, for incoming and outgoing of a work roll assembly and a backup roll assembly; and a pusher, provided on a drive side or the work side of the rolling mill, for roll admission and withdrawal for both of work rolls and backup rolls, wherein the rails for incoming and outgoing of the backup roll assembly in the rolling mill stand can be raised and lowered by hoisting and lowering means, a lower backup roll chock is equipped with a connecting fitting which can be connected to a drive end of the pusher at a raised position of the lower backup roll chock, and fixed rails for incoming and outgoing of the backup roll assembly on the work side are provided at a height consistent with a raised height of the rails for incoming and outgoing of the backup roll assembly in the rolling mill stand.

2. A roll changing apparatus for a rolling mill as claimed in claim 1, wherein a roll changing stool to be assembled to the backup roll assembly is provided with wheels and a connecting fitting for connection with the pusher so that the roll changing stool can be moved on the rails for incoming and outgoing of the work roll assembly by driving of the pusher.

3. A roll changing apparatus for a rolling mill as claimed in claim 1, wherein lower backup roll chocks of the rolling mill are provided with wheels so that the backup roll assembly can be moved by the wheels on the rails for incoming and outgoing of the backup roll assembly.

4. A roll changing apparatus for a rolling mill as claimed in claim 1, wherein the lower backup roll chock is movable on the rails and fixed rails for incoming and outgoing of the backup roll assembly via wheels.

5. A roll changing apparatus for a rolling mill, said roll changing apparatus being a side shift roll changing apparatus installed on a work side of the rolling mill, comprising:

a shift table capable of aligning with a roll axis line position of the rolling mill; and shifting rails provided on a floor and a bottom of a backup roll pulling-out pit dividedly in a shifting direction in order to support the shift table at a required height, and wherein the shift table is shifted nearly horizontally in the pit by drive means while extending over a floor rail portion and a pit bottom rail portion.

6. A roll changing apparatus for a rolling mill as claimed in claim 5, further comprising:

legs extending downwardly from an end portion of the shift table, which faces the pit, nearly perpendicularly into the pit, lower end portions of said legs being shiftable on the pit bottom rail portion while maintaining the shift table nearly horizontally.

7. A roll changing apparatus for a rolling mill as claimed in claim 5, wherein discontinuous backup roll pulling-out rails, which do not cross the pit bottom rail portion, are provided at the bottom of the pit so as to be capable of pulling out backup rolls to a higher position than the pit bottom rail portion.

8. A roll changing apparatus for a rolling mill as claimed in claim 7, wherein a pair of wheels are provided on a lower portion of a roll chock of the backup roll with a spacing greater than a lengthwise dimension of a discontinuous portion of the backup roll pulling-out rails.

9. A roll changing apparatus for a rolling mill as claimed in claim 7, wherein a slide member of a length larger than a lengthwise dimension of a discontinuous portion of the backup roll pulling-out rails is provided on a lower portion of a roll chock of the backup roll.

10. A roll changing apparatus for a rolling mill as claimed in claim 5, further comprising:

a second shift table connected to the shift table, and wherein the second shift table shifts such that one end thereof is detachably connected to and supported by an end portion of the first shift table facing the pit, and the other end thereof is supported on the floor rail portion on a side opposite to the first shift table, with the pit being located between the first shift table and the floor rail portion, and the second shift table is supported on the floor rail portion at opposite end portions thereof in a state in which the first shift table has stopped at the roll axis line position of the rolling mill.

11. A roll changing apparatus of a side shift type for a rolling mill, installed on a work side of the rolling mill, comprising:

rails, provided in a stand of the rolling mill and on a work side of the rolling mill, for incoming and outgoing of a work roll assembly and a backup roll assembly;

a pusher, provided on a drive side or the work side of the rolling mill, for roll admission and withdrawal for both of work rolls and backup rolls;

a shift table capable of aligning with a roll axis line position of the rolling mill; and shifting rails provided on a floor and a bottom of a backup roll pulling-out pit dividedly in a shifting direction in order to support the shift table at a required height, and wherein the shift table is shifted nearly horizontally in the pit by drive means while extending over a floor rail portion and a pit bottom rail portion.

12. A roll changing method for a rolling mill, used in operating a roll changing apparatus of a side shift type installed on a work side of the rolling mill and having a shift table to be aligned with a roll axis line position of the rolling mill, comprising:

actuating a work roll assembly and a backup roll assembly by a single pusher, provided on a drive side or the work side of the rolling mill, for roll admission and withdrawal, whereby the work roll assembly and the backup roll assembly are admitted into or withdrawn from a rolling mill stand, and shifting the shift table by moving the shift table on shifting rails provided on a floor and a bottom of a backup roll pulling-out pit dividedly in a shifting direction.

* * * * *